US006367219B1

(12) United States Patent
Quinlan

(10) Patent No.: US 6,367,219 B1
(45) Date of Patent: Apr. 9, 2002

(54) BUILDING CAVITY ASSEMBLY

(75) Inventor: Francis Quinlan, Leeds (GB)

(73) Assignee: New Market Developments Ltd. (GB)

( * ) Notice: Subject to any disclaimer, the term of this patent is extended or adjusted under 35 U.S.C. 154(b) by 0 days.

(21) Appl. No.: 09/304,405

(22) Filed: May 4, 1999

(30) Foreign Application Priority Data

| | | |
|---|---|---|
| May 7, 1998 | (GB) | 9809611 |
| Mar. 12, 1999 | (GB) | 9905667 |
| Mar. 13, 1999 | (GB) | 9905756 |
| Apr. 14, 1999 | (GB) | 9908382 |

(51) Int. Cl.[7] ..... E04B 5/00
(52) U.S. Cl. ..... 52/506.06; 52/508; 52/404.2
(58) Field of Search ..... 52/404.2, 405.3, 52/537, 506.06, 508, 512

(56) References Cited

FOREIGN PATENT DOCUMENTS

| | | | |
|---|---|---|---|
| DE | 196 29 180 A1 | | 1/1998 |
| EP | 0 107 054 A1 | | 5/1984 |
| EP | 0 771 915 A1 | * | 5/1997 |
| GB | 2 198 464 A | * | 6/1988 |
| GB | 2 306 981 A | | 5/1997 |

* cited by examiner

*Primary Examiner*—Carl D. Friedman
*Assistant Examiner*—Patrick J. Chavez
(74) *Attorney, Agent, or Firm*—Jenkins & Wilson, P.A.

(57) ABSTRACT

The present invention relates to a building cavity assembly and, in particular, a building cavity assembly having a thermal break to prevent the development of cold spots acting as a gathering point for condensation.

A building assembly comprising an inner and outer skin defining an insulating cavity, a support bar fixedly located in the cavity for mounting the outer skin thereon and an insulating spacer fixedly located between the support bar and the inner skin to provide a thermal break between the inner and outer skins is described. The support bar and the spacer are connected by means of a metal fixing device which passes through at least a part of the support bar and secures it to the spacer and fixes the spacer to the inner skin. The fixing device includes insulating means to insulate it from the support bar and prevent any metal to metal contact therebetween. Methods of use on roof and wall claddings are also described.

20 Claims, 10 Drawing Sheets

BUILDING CAVITY ASSEMBLY

The present invention relates to a building cavity assembly and, in particular, a building cavity assembly having a thermal break to prevent the development of cold spots acting as a gathering point for condensation.

Condensation can be a significant problem in buildings where warm, humid interior air meets the relatively cold surface of an exterior wall or roof (supercooling). The use of insulating material in the wall or roof cavity generally prevents loss of heat on the inner wall or roof skin as a result of a drop in temperature on the outer wall roof skin which is exposed to external weather conditions. However, cold spots may occur where there is a connection between the inner and outer skins such as those caused by roof fixing screws and support bars. The problem is particularly acute because of the relatively high conductivity of the metal screws and metal bars used in most roof and wall cavity assemblies. Much work has been directed to methods of preventing the transition of vapour across the cavity. Heavy gauge polythene has been used as a vapour barrier together with a liner panel. However, due to the numerous fixings which are necessary to fix the inner skin to the underlining purlins and to space the outer skin from the inner skin, holes and gaps are formed in the vapour barrier which diminishes its effectiveness. As a result, further improvements have been suggested such as the addition of a layer of gas permeable paper to reduce the exposure of the insulation to moisture from condensation.

Recently, an alternative solution to the condensation problem has been proposed. In most roof and wall cavity assemblies the basic construction consists of an inner and outer skin which are spaced from each other to provide a cavity to contain the insulation material. Generally, the inner skin is fixed to part of the building structure such as a roof and wall purlin and the outer skin is laid on support bars which are themselves mounted on brackets which space the support bar from the inner skin. For safety, the brackets are generally connected to the inner skin and the underlining roof structure such as the purlin. As the brackets and support bars are generally made from steel and the inner and outer skins from steel or aluminium, a thermal bridge is formed between the outer skin and the inner skin so that cold spots/cold bridging may be formed on the inner skin in the area of the bracket fixing. A solution suggested is to mount an insulating plastic cap on top of the bracket so that the insulating cap comes into contact with the support bar, thus providing a thermal brake between the inner and outer skins. Unfortunately, the system suffers from a number of drawbacks. Firstly, the thermal break is not complete and there is still some metal to metal contact between the metal support bar and the metal purlin below the plastic mounting so that condensation points still develop along the interior of the roof itself and allow moisture to collect. Secondly, it is necessary to lay the insulation round the brackets once they have been fitted to the inner skin causing damage to the insulating material and providing gaps in the insulation. Due to this, the proposed solution only compounds the problem and leaves significant gaps in the insulating material so that condensation forms on the inner roof skin despite the existence of the partial thermal break. Thirdly, the structure relies upon a snap-fit fixing between the support bar and the bracket and this may suffer from failure in extreme conditions causing roof damage and presenting safety hazards both during and after completion.

According to the present invention there is provided a building assembly comprising an inner and outer skin defining an insulating cavity, a support bar fixedly located in the cavity for mounting the outer skin thereon and an insulating spacer fixedly located between the support bar and the inner skin to provide a thermal break between the inner and outer skins, the support bar and the spacer being connected by means of a metal fixing device which passes through at least a part of the support bar and secures it to the spacer and fixes the spacer to the inner skin, wherein the fixing device includes insulating means to insulate it from the support bar and prevent any metal to metal contact therebetween.

Preferably, the insulating means forms a sheath around the fixing device at least where it may come into contact with the support bar. Preferably, a washer is located between the support bar and the fixing device to prevent contact of the fixing device with the part of the support bar against which it is urged, which washer includes an extension sheath to surround the part of the fixing device which passes through the support bar and thereby prevent any contact between the support bar and the fixing device.

Advantageously, by preventing any contact between the support bar and the fixing device, the fixing device does not act to conduct the temperature of the support bar onto the inner skin. In this way, it has been found that the heat loss measured as a U-value is significantly lower through the building assembly of the invention compared with one where the fixing device does not include insulating means or compared with composite panels. For instance, it has been shown that the U-value for a comparable composite panel or prior art building assembly without insulation means on the fixing device show U-values of approximately 0.45 whereas the building assembly of the invention shows a U-value of 0.30–0.38.

This comparison has been made with composites of standard thickness 45 mm and building assembly insulation material of conventional thickness of 80 mm. Thus use of the invention has been shown to significantly lower heat loss through roofs and walls.

Accordingly to a further aspect of the present invention there is provided a method of assembling a twin skin roof or wall cladding on a building comprising the steps of:

- locating an inner skin over at least one underlying frame member such as a purlin;
- locating insulating spacers at intervals on the inner skin at locations over the said underlying frame member;
- locating an insulation layer such as glass wool on the said inner skin and over the said insulating spacers;
- mounting an outer skin metal support bar on the insulating spacers; and
- fixing the support bar to each insulating spacer and each spacer to the inner skin and underlying frame member with a metal fixing device; wherein the said metal fixing device includes insulating means to insulate it from the support bar and prevent any metal to metal contact therebetween.

Preferably, the insulating means forms a sheath around the fixing device at least where it may come into contact with the support bar. Preferably, a washer is located between the support bar and the fixing device to prevent contact of the fixing device with the part of the support bar against which it is urged, which washer includes an extension sheath to surround the part of the fixing device which passes through the support bar and thereby prevent any contact between the support bar and the fixing device.

Preferably, the fixing device insulating means is in the form of a washer with a socket extension thereto to thereby respectively insulate the head and sides of the fixing device from the support bar. The fixing device insulation means and the spacer can be made from a material of lower heat conductivity than that of the neighbouring parts. Preferably, the fixing device insulation means and spacer is plastic.

Preferably, the outer skin is secured to the support bar. The support bar is, typically, a metal Z-bar ie. a support bar with a Z-shaped cross-section which is of the type familiar to the man skilled in the art.

Preferably, particularly for wall cladding, the insulation layer such as glass wool is held in place over the spacers by means of a locating washer which is close fitting with the spacer and may be placed therearound to hold the insulation layer in position. This is particularly advantageous for wall cladding where the insulation layer may otherwise fall under gravity in the cavity between the inner and outer skins. Preferably, the locating washer has sufficient area to prevent the insulation layer being lifted thereabove without tearing of the layer. The locating washer may be expanded to suit the tearing resistance of the insulation layer and/or the working life of the cavity. The wider the periphery of the washer, the longer the insulation is likely to remain in place.

Preferably, the building assembly is a roof or a wall cavity.

Preferably, the dimension of one end of the spacer is smaller than the dimension of the other end thereof. Advantageously, the increasing dimension of the spacer along its length assists the fitting of insulation from the narrower end thereof.

In accordance with the invention, insulating material may be fitted over the spacer, prior to securement of the support bar and outer skin, thereby engaging the smaller end first so that accommodating holes formed in the insulating material as it advances over the smaller end are close fitting therewith and form a tight fit with the wider end of the respective spacers as they are advanced towards them.

Advantageously, the shape of the spacer allows the insulating material to be more easily located thereon.

Preferably, the spacer comprises a fixing device receiving section for securement of the said fixing device.

Preferably, the spacer comprises support webs, one end of which provides a cutting edge for the insulating material. Preferably, the cutting end forms the narrower end of the spacer so that insulating material may be cut into, using the narrower end of the web, and then advanced thereover towards the wider ends of the said webs. Preferably, the outer sides of such webs also provide cutting edges for the said insulating material. Preferably, the spacer comprises a plurality of radially extending webs, preferably, at least four such webs. Preferably, the webs are mounted on a flat plate at the wider end thereof.

The said flat plate is, typically, orientated to be urged against the inner skin in wall cladding assemblies, this provides a stable base upon the other end of which spacer the support bar and outer skin is mounted. A position holding screw is also, typically, located in the said flat plate to secure the flat plate of the spacer in position prior to support bar and insulation layer installation, the position holding screw provides for even base plate abutment against the underlying inner skin, thus providing a securer base for the outer skin and, preferably, avoiding a spacer being located with the flat plate at an angle to the inner skin during support bar fixation.

It is also envisaged, particularly for roofing applications, that the method step of locating the spacers may be carried out after the laying of the insulation layer, with the spacers temporarily held in position by inserting them through the thickness of the insulation layer. For roofing applications, the spacer is, preferably, located with the flat plate uppermost. This provides a more stable base for the overlying support bar and, allows minimum tearing/cutting of the insulation layer by contacting the insulation layer with the sharper webbed ends of the spacer as opposed to the flat plate end thereof. Preferably, the webs extend radially from a central fixing device receiving section.

Preferably, the fixing device is a screw and the receiving section is a tapped hole formed in a central cylinder from the outside of which the said webs radiate.

Advantageously, this facility leaves the cut sections of the insulation around the central receiving section of the spacer and thereby provides additional insulation around the centre of the spacer.

As the spacer is webbed, preferably, radially, it provides a structure with increased strength whilst providing more convenient insulation location. The flat plate of the spacer may be adapted to accommodate a temporary fixing screw to temporary fix the spacer to the inner skin prior to the application of the fixing device. The latter feature is particularly advantageous for use on vertical walls and exposed locations.

Preferably, locating discs are located over the spacers after laying the insulation thereover so that the insulation is secured in position. The increasing radius of the outer limit of the radially extending webs enables a friction fit between a locating disc and the spacer as the former is urged thereover. The locating disc is, preferably, designed with receiving section and web accommodating cut-outs, preferably in the form of web slots radially extending from a central hole designed to accommodate the outer walls of the fixing device receiving section.

Advantageously, the locating discs prevent the insulation being blown off the roof of the building or, in the case of wall skins, collapsing under gravity in the cavity between the said skins.

Preferably, the radial outer limit of the web slots is designed to be close fitting with the outer radial edge of the spacer webs at a predetermined distance from the top of the spacer, suitable for securing the insulating material.

It is possible that the spacer is not tapered but such would have disadvantages, particularly in respect of securement of the locating washer thereover.

Advantageously, the support bar and fixing device may be secured to the spacer after the spacers and insulation are safely fitted into position on the inner skin. Preferably, this is facilitated by snap fit or temporary fixings on the spacer flat plate which hold it in position with respect to the inner skin and underlying roof structure prior to securement to the support bar with the fixing device.

Alternatively, the insulation may be located over the inner skin and the spacer fitted thereon with the flat plate uppermost and for this embodiment the insulating means may be received at the flat plate end of the spacer and/or the opposite end thereof.

In either case, preferably, the fixing device receiving section is sufficiently wide to enable it to accommodate any part sheathed by the insulating means.

The snap fit temporary fixings may be received in accommodating holes in the inner skin and, preferably, the underlying roof structure, possibly formed by utilising a jig with pre-formed holes.

Preferably, the fixing device is a screw. Preferably, the head of the screw is urged against the support bar and separated therefrom by a washer, whereas the shaft of the screw is sheathed by a sheath which extends from the washer partially down the shaft of the screw and thereby prevents any contact between the head of the screw and the support bar or the shaft of the screw and the support bar as the former passes through the support bar into the spacer and underlying skin. In this manner, no metal to metal contact between the outer roof skin and the inner roof skin is possible even though a metal fixing screw secures the insulating spacer to the inner roof sheet and the support bar to the spacer. Thus, a very secure and strong roof structure is made available without compromising insulation efficiency.

The spacer may be temporarily fixed by using suitable adhesive to allow laying of insulation and then to more securely fix it with a fixing screw at the same time as the support bar is fitted.

A preferred feature is that the spacer may be temporarily fixed to the "Z" bar by means of a triangular cross-section type washer moulded in the spacer in the central shaft of the spacer where the screw initially penetrates and is held when securing the spacer to the underlying purlin or other weight bearing member to both roof and wall.

The fixing screw preferably secures the spacer to the inner skin and underlying purlin or other weight bearing member.

According to a second aspect of the present invention, there is provided a building cavity assembly comprising an inner and outer skin defining an insulating cavity, a support bar fixedly located in the cavity for mounting the outer skin thereon, wherein the support bar is made from an insulating material to provide a thermal break between the outer skin and the remainder of the building cavity assembly.

Preferably, the support bar is mounted on a spacer which is fixedly located between the support bar and the inner skin. The use of an insulating material to form the support bar is particularly advantageous because it overcomes an inherent problem with the use of an insulating material on the spacer between the inner skin and the support bar. In this latter case, it is necessary to secure the support bar to the spacer and this is, preferably, carried out by means of a single fixing which penetrates the spacer and secures it to the inner skin and the underlying purlin or other fixed structure. Unfortunately, the fixing screw provides a thermal bridge between the support bar and the inner skin despite using insulating material to form the spacer. This problem is overcome by breaking the thermal bridge at its source, the outer skin, by utilising an insulating material to form the support bar.

Preferably, the dimension of the distal end of the spacer with respect to the inner skin is smaller than the dimension of the proximal end. Further preferred features and advantages of the type of spacer and fixing device insulating means may be ascertained by reference to the preferred features and advantages of the features of the first aspect of the invention.

Advantageously, with respect to both aspects of the invention, a further problem in the prior art is avoided. In one prior art solution, which suggests the use of the bracket with an insulating cap, it is necessary to provide a two component bracket i.e. a metal base and, generally, a plastic cap. The twin component spacer causes an inherent weakness in the prior art solution. If assembled on-site, it necessitates a further fixing operation and, if manufactured off-site it is necessary to use further screws or adhesive to fit the plastic cap to the spacer bracket. This increases manufacturing costs and also leads to safety problems. For instance, in the event of a fire, it is likely that the plastic cap and/or adhesive would become damaged or melt and cause the roof structure to collapse.

A support bar may be box shaped or may be in the form of a Z bar. Generally, however, it is preferred that a Z bar is used.

The spacers may be held in place during roof assembly using snap fit plastic holders, these may depend directly from the base of the spacer or may protrude through a mounting plate upon which the spacer is mounted. Alternatively, the spacers may be located in position using a magnet. The snap fit holdings may be temporary and, in this case, may be designed so that they are expelled during final securement with the fixing screw. In this manner, it is possible to hold the spacers in position while the insulation material is fitted and before a final fixing screw secures the support bar to the spacer, penetrating the latter to secure it to the underlying structure.

In an alternative to the spacer embodiment, the top of the spacer may extend further to provide a fixing arm or arms for the support bar. In this manner, it is possible to provide an alternative fixing location for the support bar which is independent of the fixing screw of the spacer, thus permitting the use of a steel support bar or a support bar made from any other conducting material, with a thermal break between the support bar and the metal fixing screw for the spacer.

Preferably, the locating disc is designed with receiving section and web accommodating close fitting cut-outs.

Preferably, the radial outer limit of the web cut-outs is designed to meet with the outer radial edge of the spacer webs at a predetermined distance from the top of the spacer, suitable for securing the insulating material.

Preferably, the fixing device is a screw.

Preferably, wherein the spacer is temporarily fixed to the support bar by means of a holding means in the central shaft of the spacer where the screw initially penetrates and is held when securing the spacer to the underlying purlin or other weight bearing member.

Preferably, the holding means is a pre-moulded cross section of the central shaft of the spacer.

Preferably, there is also provided an insulating spacer for use in a building cavity assembly wherein the dimension of one end of the spacer is substantially smaller than the dimension of the other end thereof.

Accordingly, according to a third aspect of the present invention, there is provided a building cavity assembly comprising an inner and outer skin defining and insulating cavity, a support bar fixedly located in the cavity for mounting the outer skin thereon and an insulating spacer fixedly located between the support bar and the inner skin to provide a thermal break between the inner and outer skins, wherein the spacer has an arm or arms extending therefrom to provide a fixing point for the support bar which is independent of the fixing for the spacer itself.

Alternatively, the support bar could be adapted to avoid the necessity to use the fixing arm on the spacer. In this case, the support bar itself could include arms which at least partially extend along the spacer and are, thereafter, secured into the spacer by a suitable fixing means, such as accommodating holes formed in the spacer to receive screws.

According to fourth aspect of the present invention there is provided an insulating spacer for use in a building cavity assembly wherein the dimension of one end of the spacer is substantially smaller than the dimension of the other end thereof. Preferably, the spacer comprises wedge means to provide the dimensional variation.

According to a fifth aspect of the present invention there is provided a support bar for locating in a building cavity for mounting the outer skin of the said building cavity thereon, wherein the support bar is substantially made from an insulating material.

According to a sixth aspect of the present invention, there is provided a spacer in accordance with the fourth aspect of the present invention, wherein an arm extends from one end of the spacer to provide a fixing location for the support bar.

Embodiments of the invention will now be described, by way of example, with reference to the accompanying drawings in which:

FIG. 1*a* shows a first Z bar, spacer and insulation configuration in accordance with the prior art, FIG. 1*b* shows a second arrangement of a Z bar spacer and insulation in accordance with the prior art, FIG. 1*c* shows a spacer bracket and insulating cap in accordance with the prior art, FIG. 2 shows a Z bar, spacers and insulation in accordance with the present invention, FIG. 3 shows a perspective view of an arrangement of spacers and a Z bar in accordance with the present invention, FIGS. 4(*a*)–(*d*) shows different methods of locating the spacers prior to fixation, FIGS. 5(*a*)–(*c*) shows a manner in which snap fit and permanent fixation may be employed in accordance with the present invention, FIGS. 6(*a*)–(*b*) show the methods of spacer fixation in accordance with the present invention, FIGS. 7(*a*)–(*g*) show alternative means to secure the spacer and support bar together in accordance with the present invention, FIG. 8(*a*) shows a front elevation of a spacer and insulating washer according to the present invention, FIG. 8(*b*) shows a side elevation of a spacer and insulating washer according to the present invention, FIG. 8(*c*) shows a plan elevation of a spacer and insulating washer according to the present invention.

FIG. 10(*b*) shows a roof cladding arrangement for the spacer and Z bar; and FIG. 10(*c*) shows a further embodiment of location washer in accordance with the invention.

Figure 1A:
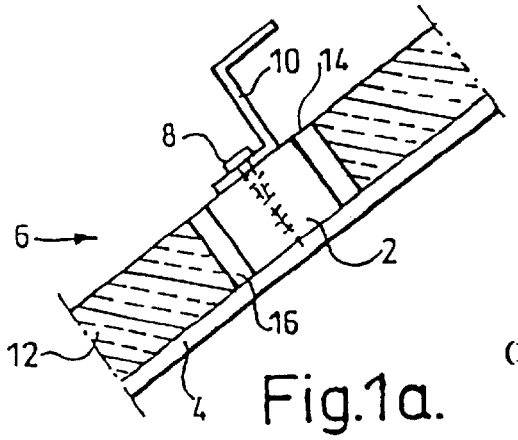
Fig.1a. (PRIOR ART)
Figure 1B:
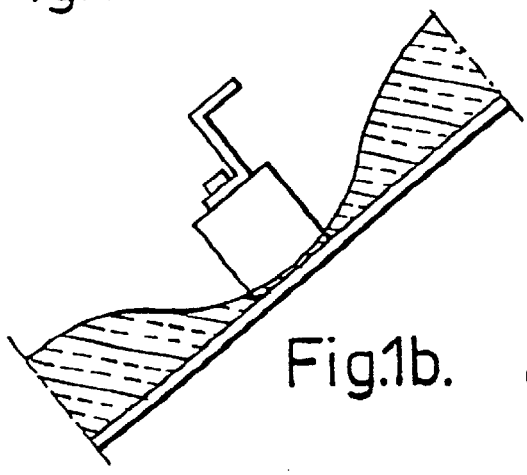
Fig.1b. (PRIOR ART)

Referring to FIGS. 1*a* and 1*b,* a prior art arrangement is shown in which a plastic spacer or ferrule 2 is secured to an inner sheet 4 of a suitable building cavity 6 by a fixing screw 8 which simultaneously secures the base arm of a Z bar 10 to the upper surface of the spacer 2. Suitable insulating material 12 surrounds the spacer 2 and avoids interference with the spacer arrangement by means of a suitably sized hole 14 which is formed in the insulating material so that it may be placed over the spacer after the spacer has been secured to the inner sheet 4. An annular cavity 16 is formed between the insulating material and the outer walls of the spacer through which cooler air from the outer sheet (not shown) may gain access to the inner sheet 4. Although attempts may be made to reduce the size of the annular cavity 16, very precise measurements are necessary to avoid the insulation becoming snagged or caught on the spacer 2. To avoid such snagging, it is necessary to cut the hole 14 slightly larger than is required by the spacer 2 and this, inevitably, results in the formation of the annular cavity 16.

An alternative to the above method of fixation of the spacer, Z bar and insulation is to fit the insulation material prior to fixation of the spacer as shown in FIG. 1*b*. However, although this avoids the problem of generation of an annular cavity 16 between the inner and outer sheet, it reduces the effectiveness of the insulating material which is compressed beneath the spacer. A further disadvantage of this method is that the pre-punched holes in the inner roof sheet, which are formed to provide a fixing location for the spacers, are obscured by the insulation material rendering securement of the spacer more difficult. Given the necessity to cut away the thermal material around the spacer as described with respect to FIG. 1*a* and the necessity to find the pre-punched hole under the insulation material as defined in FIG. 1*b,* the prior art spacer arrangements suffer from being labour intensive.

Furthermore, the method defined in respect of FIGS. 1*a* and 1*b* uses the Z bar 10 as an alignment device for the spacer 2. In use, the Z bar obstructs the laying of the wall insulation as defined in respect of FIG. 1*a,* leading to further insulation problems. With respect to both methods, a steel fixing screw is necessary to fix the spacer to the inner roof sheet 4, reducing the effectiveness of the thermal brake provided by the plastic spacer 2, by providing a thermal bridge between the outer sheet (not shown) and the inner sheet 4. A still further problem with the method described with respect to FIG. 1*a* is the lifting of the insulation material during blustery conditions, causing the insulation to become misplaced.

Figure 1C:
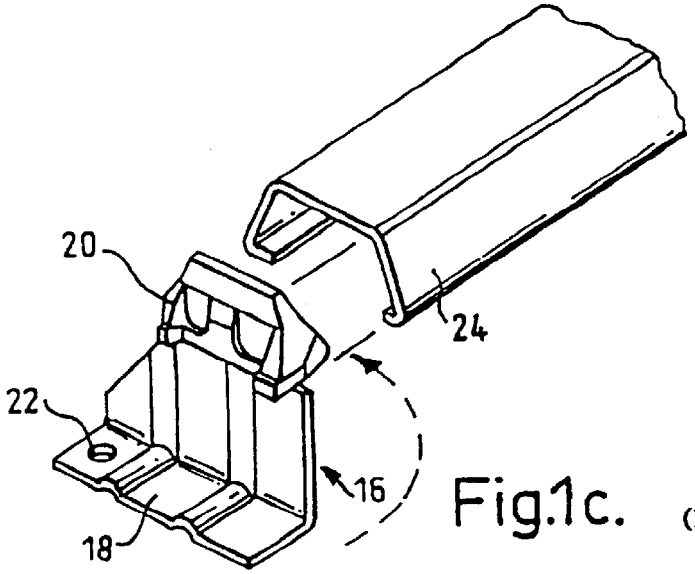
Fig.1c. (PRIOR ART)

Referring to FIG. 1*c* a capped spacer bracket 16 comprises an L-shaped bracket 18 and a plastic insulating cap 20. The base of the L-shaped bracket includes a fixing hole 22 for receiving the suitable screw for fixing to the inner sheet (not shown). The insulating cap 20 is mounted on the top of the vertical side of the L-shaped bracket 18 and is designed to be close fitting with the inner walls of a support bar 22. The support bar is trapezoidal in cross-section with the base partially cut away to leave a small border on each side which is used to slide under the bottom outer edges of the cap 20 to secure the cap and the support bar together. However, there is no break in the thermal bridge because the bar is secured under the isolating cap thus maintaining a metal to metal snug-fit. Condensation still develops around the support bar itself which, in time, will damage the insulating material within the cavity assembly. Furthermore the arrangement causes several safety problems including, the risk of the plastic cap melting in the event of high temperatures or fire, which may cause the roof structure to collapse. Furthermore, the connection between the cap and the bracket is relatively weak which may cause the two components to separate during use, leading to roof damage and eventual collapse.

Figure 2:
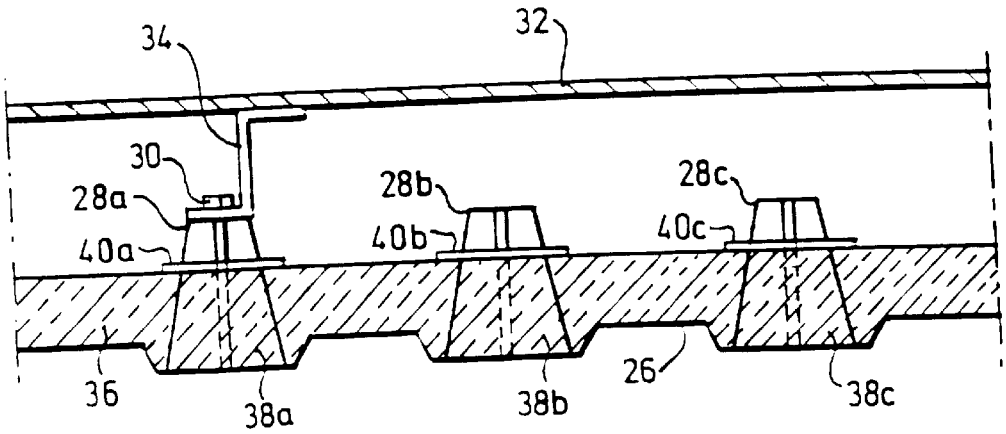

Referring to FIG. 2, a partial cross-section through a cavity assembly in accordance with the present invention is shown. An inner roof sheet 26 has a series of spaced, aligned spacers 28 located thereon by means of fixing screws such as 30. The upper sheet 32 rests on Z bars such as 34 whose base arm is secured, by means of a screw 30, to the top of the spacer 28*a*. Insulating material 36 is located on the inner sheet 26 and is closely fitted to the outer walls of each of the spaced, aligned spacers, providing an uninterrupted insulating barrier between the inner and outer roof sheets 26, 32. In addition, the hollow spacers 28 are filled with plugs of insulating material 38. The central portion of the spacer 28 provides a capped sheath for the fixing screw 30 which is secured to the inner walls of the spacer by means of webs (not shown) which extend radially from the outer walls from the centrally disposed sheath to the inner walls of the spacers 28. Generally, the upper edges of the webs and the upper edge of the spacer are sufficiently sharp to allow them to bite into the insulating material as it is advanced thereover. Depending upon the number of webs in the spacers, a number of plugs of insulating material 38 will be left within the spacer to provide additional insulation.

One method of assembling the roof or wall structure is to secure the inner sheet 26 to components of the underlining roof or building structure such as purlins. After securing the inner roof or wall sheet, the spacers are located thereon in the aligned fashion necessary to fix the Z-bar 34. Once these spacers are fixed in location, the insulating material 36 may be advanced thereover to lie flush against the inner roof sheet 26. As the insulating material advances over a spacer, a plug of material 38 is cut from the insulating material which has a diameter approximately equal to the diameter of the upper edge of the spacer. The spacers are frustoconical in vertical section so that as the insulating material is advanced towards the inner roof or wall sheet 26, the walls of the holes formed by the upper edge of the spacer is expanded to provide a tight fitting insulating seal with the outer walls of the spacers 28. The Z-bar may then be located over the spacers and secured thereon by a fixing screw 30 which extends through the centrally disposed sheath (not shown) in the spacers 28 to secure both the spacer and the Z-bar 34 to the inner roof sheet 26. The outer roof sheet may then be fitted to the upper arm of the Z-bar 34 in the manner known to the person skilled in the art.

Optionally, and as shown in FIG. 2, a locating disc 40 secures the insulating material in place after it has been advanced over the spacers 28. The locating disc is generally in the form of a washer having an inner hole which is dimensioned to pass only partially down the sides of the frustoconical spacers. Generally, it is designed so that the inner edge of the washer abuts against the outer wall of the spacer at the height above the inner roof sheet 26 where it is required to secure the insulating material 36.

Figure 3:
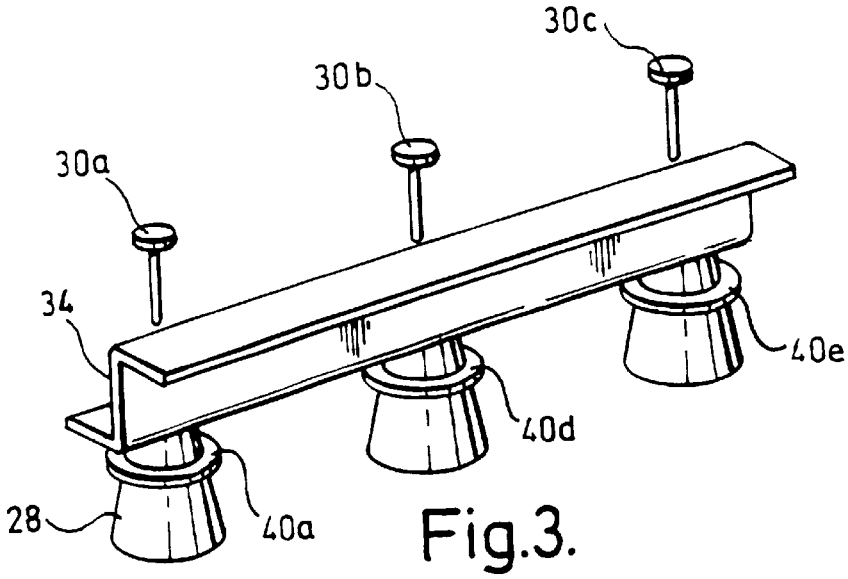

Referring to FIG. 3, a schematic diagram shows an aligned series of spaced spacers with the Z-bar 34 located thereon prior to fixation using the fixing screws 30 (*a–c*).

FIGS. 4(*a*)–(*d*) show a variety of methods of locating the spacers prior to permanent fixation with the fixing screws.

Referring to FIGS. 4(*a*) and 4(*b*), an alternative design of spacer in accordance with the present invention is shown which has the construction of the spacer described with respect to FIG. 2 with the outer wall removed. In this case, the base plate 42 has a series of 4 radially extending webs 44 centrally mounted thereon and a central capped shaft from which the webs extend and in which the fixing screw 48 is secured. A small temporary screw for locating the spacer in position prior to fixation with the fixing screw 48 is located in the base plate and is used to secure the spacer to the inner sheet 50 during laying of the insulating material 52. An alignment jig 54 is used to locate a series of spacers 42 in position using appropriately spaced, downwardly depending fingers 56 which are dimensioned to be located in the tapped sheath 46 formed in the centre of the spacers 42. The method of fixation is to locate the spacers using the alignment jig 54 and to secure them in position using the screw hole 56 formed in the base plate 42, to the inner sheet 50. Once the spacers are located in position in this manner, the insulating material may be advanced thereover to form a tight fit between the webs and the insulating material. Between the webs, the insulating material will collapse in on the inter web space to increase insulation. After the insulating material is fully laid it may be located in position using a suitable locating washer 58. Thereafter, the Z-bar and fixing screw may be assembled as defined with respect to FIGS. 2 and 3.

Figure 4A:
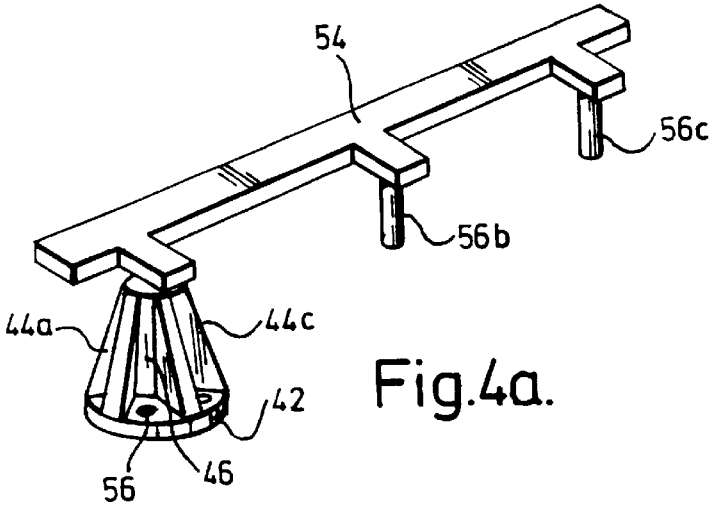
Figure 4B:
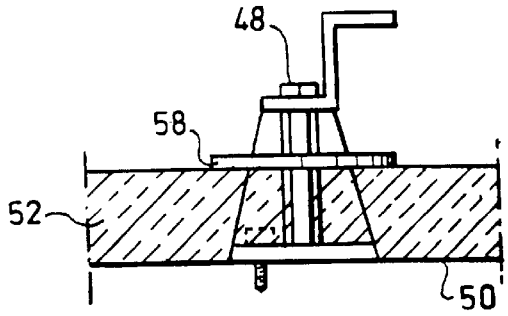
Figure 4C:
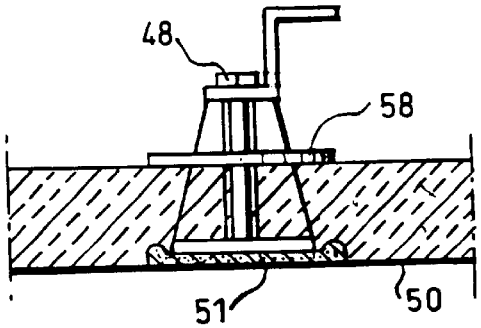

Referring to FIG. 4*c* a similar arrangement to that defined with respect to FIGS. 4(*a*) and 4(*b*) is shown. The spacer is in accordance with that described with respect to FIG. 4*a* except that the hole in the base plate is not present and the base plate is temporarily secured to the inner sheet 50 by means of an adhesive.

Figure 4D:
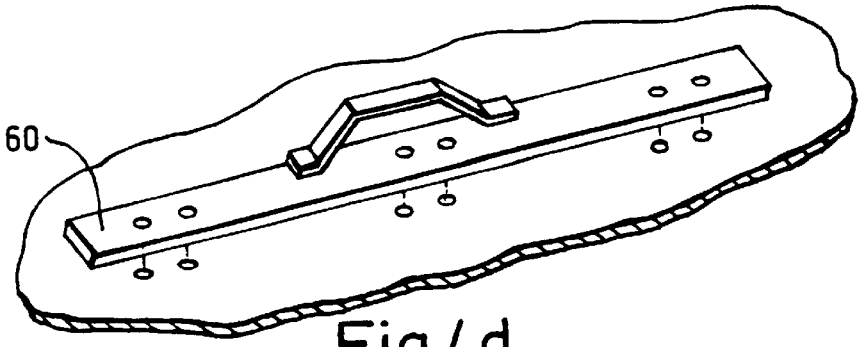

Referring to FIG. 4*d,* a different arrangement is shown. In this case, the spacer has a pair of snap fit protrusions depending from the underside of the base plate which may be located in holes formed in the inner sheet 50 by means of an alignment jig 60 which has appropriately spaced pairs of holes formed therein.

Figure 5A:
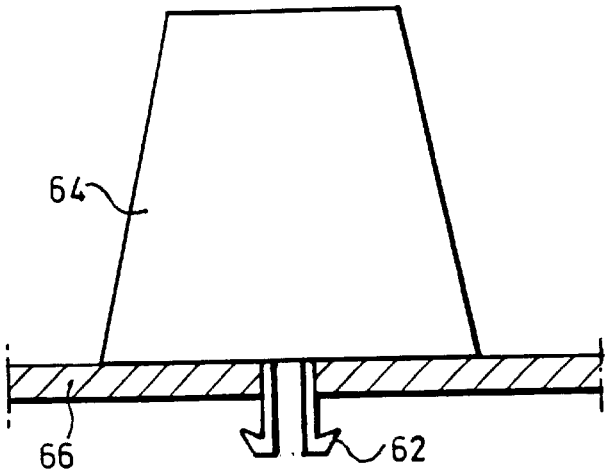
Figure 5B:
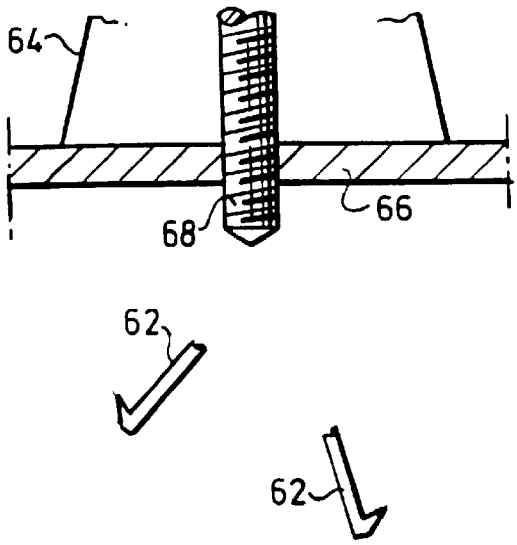
Figure 5C:
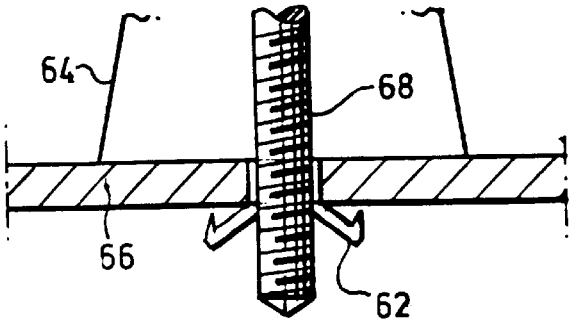

An alternative to the snap fit design shown in FIG. 4*d* is shown in FIGS. 5(*a*)–(*c*). In this case, the snap fit protrusion 62 depends from the base of the spacer cone 64 and temporarily secures it to the inner sheet 66 by means of the method defined with respect to FIG. 4*d.* However, as shown more clearly in FIGS. 5(*b*) and (*c*), as the permanent fixing screw 68 advances through the centre of the spacer 64 and into the hole formed in the inner roof sheet 66 it may either eject the snap fit protrusion as shown in FIG. 5*b* or cause it to turn radially outwardly to provide additional securement and, most advantageously, an additional thermal barrier between the inner roof sheet 66 and the screw 68. Such arrangement provides another aspect of the present invention i.e. a spacer having a downwardly depending insulating member to provide an insulating barrier between an inner roof sheet onto which the spacer is mounted and a fixing member securing the spacer to the said roof sheet.

Figure 6A:
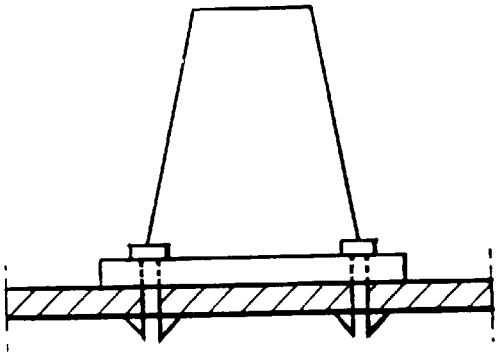
Figure 6B:
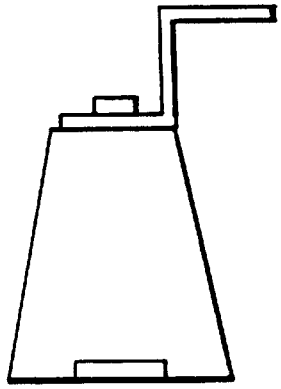

Referring to FIGS. 6(*a*)–(*b*) alternative locating means for the spacers are shown. In FIG. 6*a,* a pair of separate plastic snap fitting members extend through accommodating holes formed in the base plate of the spacer and the inner sheet onto which the spacer is mounted. Alternatively, as shown in FIG. 6*b,* the spacer may be located by means of a magnet.

Referring to FIGS. 7(*a*)–(*g*), a number of means by which the support bar and the spacer may be connected are shown. FIGS. 7*a, b, e* and *g* show a modification to the spacer which provides greater flexibility for connection of the support bar and spacer. The said Figures reveal a pair of arms 70, 72, 74 and 76 which extend vertically upwardly from the top of its respective cone. In FIG. 7*a,* a snap fit type support bar 78 has a pair of lugs 80, one on each side thereof which are received in corresponding grooves 82 formed on the inner wall of the respective arms 70. The lugs and grooves cooperate to secure the support bar 78 to the spacer 70.

Figure 7A:
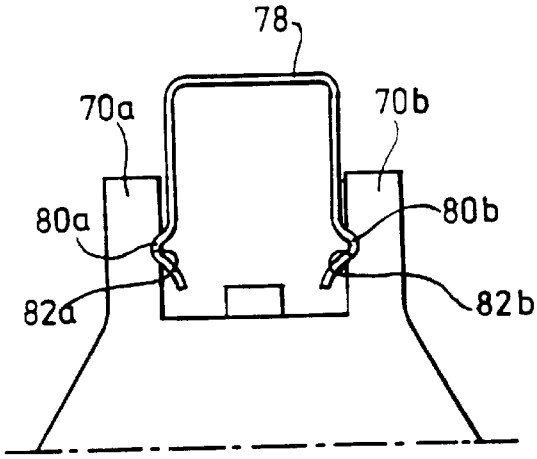
Figure 7B:
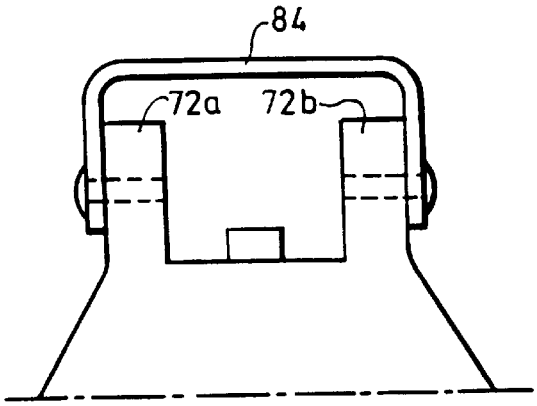

In FIG. 7*b,* a U-shaped support bar 84 extends over the arms 72 to be secured thereto by means of a screw or rivet fitting extending parallel to the roof sheets (not shown) and thus, avoiding contact between the fixing screw securing the spacer to the inner roof sheet (not shown) and the support bar.

Figure 7C:
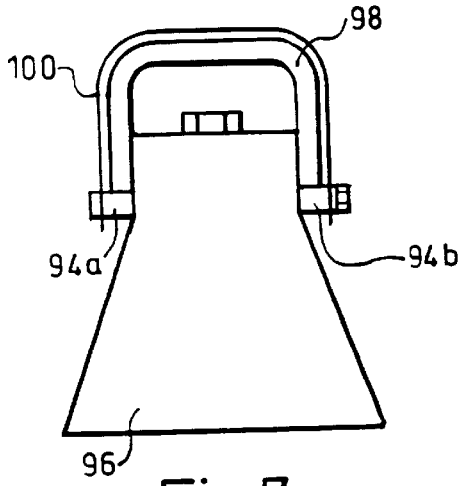
Figure 7D:
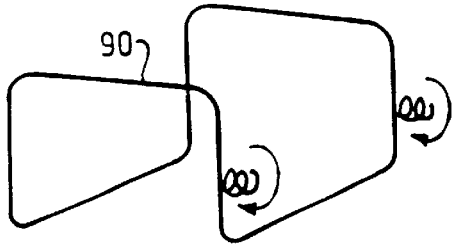
Figure 7E:
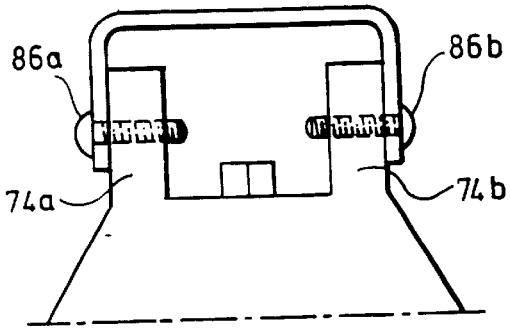
Figure 7F:
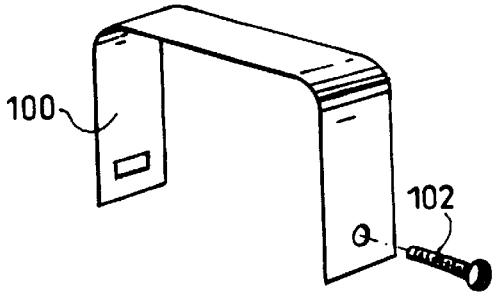
Figure 7G:
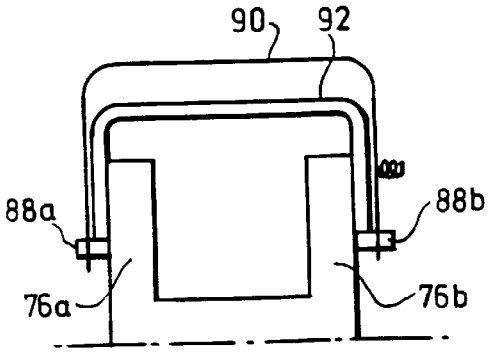

FIG. 7*e* shows a similar arrangement to that shown in FIG. 7*b* with the rivets being replaced by screws 86.

An alternative fixing method is shown in FIG. 7*d* and *g*. Here, a U-shaped support bar is fitted over the extension arms 76 until it abuts against stoppers 88 which protrude at right angles from the extension arms 76. A U-shaped wire 90 is then located over the U-shaped support bar 92 and hooked underneath the stoppers 88 to provide purchase against which the U-shaped wire 90 may be twisted to tighten and secure the U-shaped bar in position. An alternative to the extension arms is shown in FIG. 7*c* where the stoppers 94 protrude directly from the sides of the cone 96 so that the U-shaped support bar 98 may be abutted thereto and secured in position using a securing strap 100 having a slot on one side thereof which receives protruding stopper 94*a* and screw hole on the other side thereof which receives a screw 102 so that the screw can secure the strap to the opposite protrusion 94*b,* thus securing the support bar in position. Accordingly, alternatives to the strap such as the embodiments defined with respect to FIGS. 7*b, d* and *e* can also be envisaged. In any case, with or without the extension arms, the embodiments defined advantageously provide the method of fixing the support bar to the spacer which avoids contact between the support bar and the spacer fixing screw, thus providing a thermal break between the inner and outer sheets.

Figure 8A:
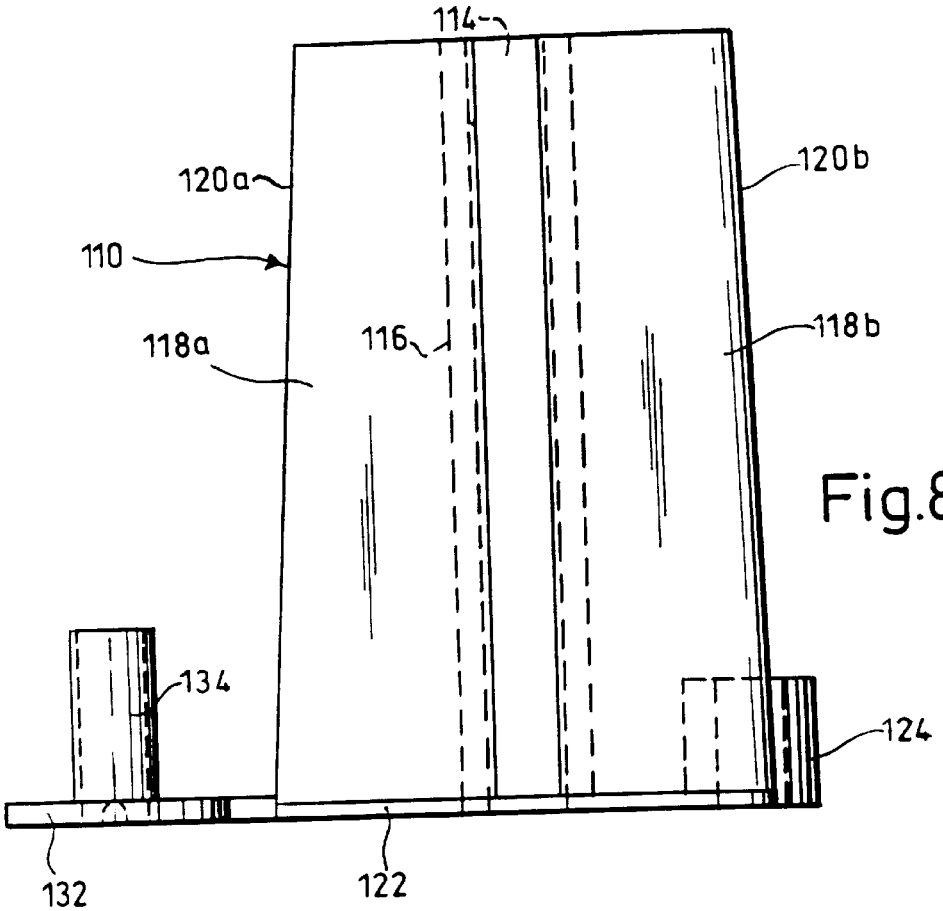
Figure 8B:
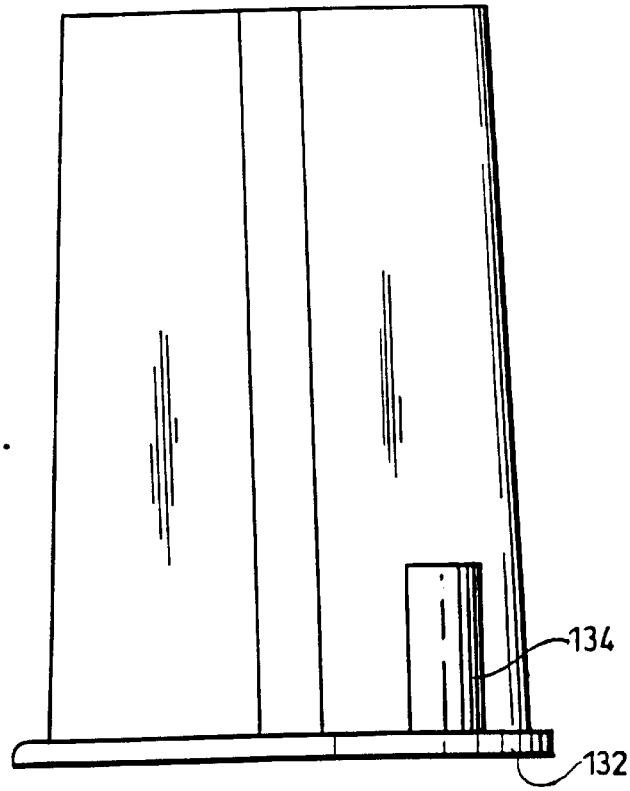
Figure 8C:
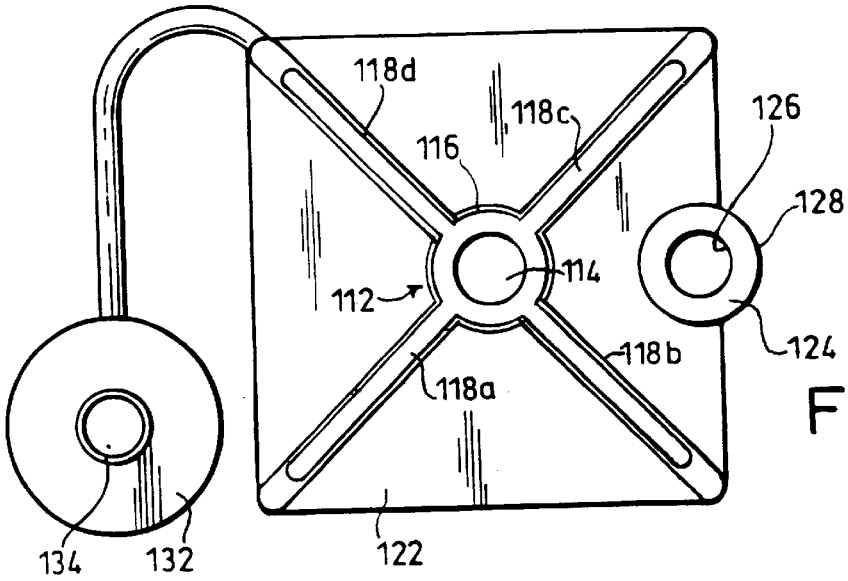

Referring to FIGS. 8(*a*)–(*c*) a spacer 110 comprises an upright hollow cylinder 112 having an inner wall in the form of a tapped hole 114 and a plane outer wall 116 which is integral with four equally spaced radially extending webs 118. The outer edges 120 of the webs 118 gradually widen towards the planar base 122 of the spacer 110 upon which the respective bases of the webs 118 and the cylinder 112 are mounted. The base 122 comprises a square plate having rounded corners and the manner of mounting the webs and cylinder is such that the centre of cylinder is located over the centre of the square base plate 122 and the webs 118 extend radially from the cylinder aligned with the diagonals of the square plate 122 in such a manner that the base of each web is flush with a respective bevelled corner of the square plate 122. Equi-distant between two of the webs is an upright temporary fixing cylinder 124 which, again, comprises an inner wall in the form of a tapped hole and a plane outer wall 128. The base of the cylinder 124 is mounted on the base plate 122 so that the axis of the cylinder passes through the plate 122 at a point spaced marginally inward from one side thereof and equally spaced from the sides adjacent to the side from which the centre of the cylinder is spaced marginally inward. Both the tapped hole in the permanent fixing 112 and the temporary fixing 124 pass through the base plate 122 so that a fixing device and temporary fixing device respectively may be secured therethrough.

A sheathing washer 130 comprises a conventional annular washer portion 132 and extension sheath 134 which forms an elongate extension to the inner walls of the central hole of the washer. In this manner, the sheath washer may be placed over a screw (not shown) so that the washer abuts against the under surface of the head of the screw and the sheath extends partially down the shaft of the screw. By fixing the sheath washer to the screw, the screw is prevented from contacting the support bar (not shown) when securing it to a spacer upon which the support bar is mounted. In this manner, the screw may pass completely through the spacer and into the inner roof sheet located below the spacer providing a secure fixing between the support bar, the spacer and the inner roof sheet whilst avoiding a thermal bridge between the support bar and inner roof sheet via the screw.

Figure 9A:
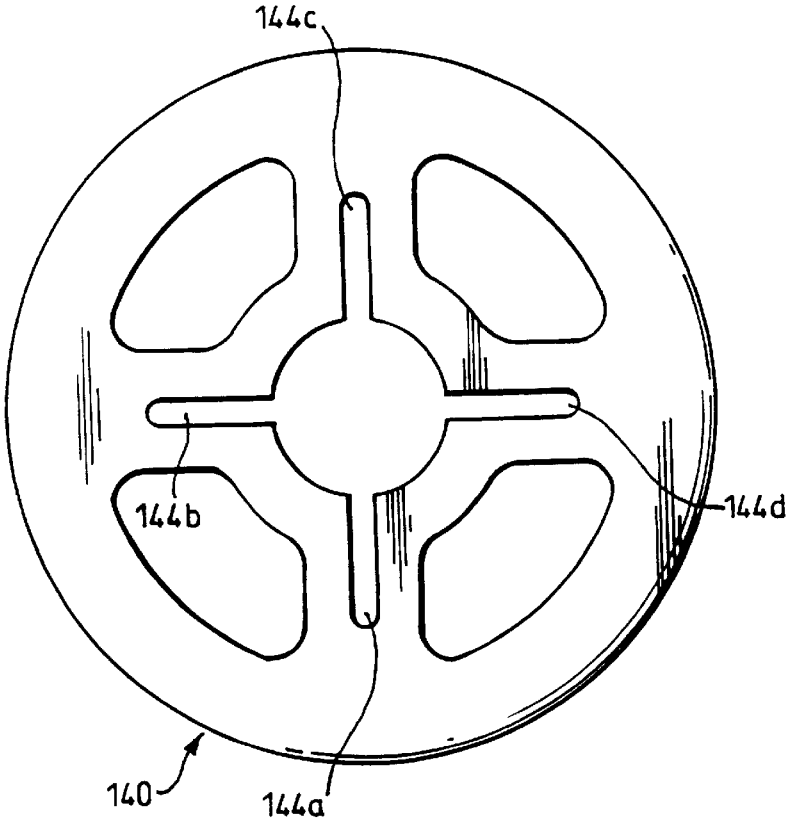
FIG. 9(*a*) shows a plan view of a locating disc according to the present invention, FIG. 9(*b*) shows a side view of a locating disc according to the present invention.
Figure 9B:
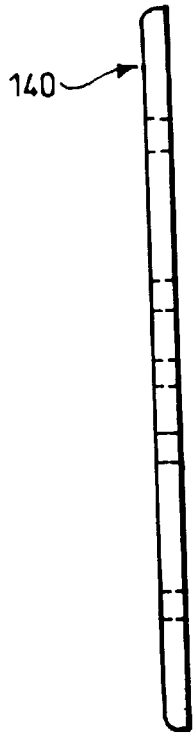

Referring to FIG. 9(*a*), a retaining disc 140 is shown for location over the spacer referred to in FIGS. 8(*a*)–(*c*). The locating disc comprises a circular piece of polymeric material having a central hole 142 which is dimensioned to be close fitting with the outer wall 116 of the spacer cylinder 112 and four equally spaced radially extending slots 144 which extend from the central hole 142 and are designed to be close fitting with the radially extending webs 118 of the spacer 110. The outer limit of the radially extending slots 144 is designed to come into close fitting engagement with the outer limit of the radially extending webs 118 at a pre-determined point along the length thereof which is a suitable point for securement of insulating material located over the webs 118. In this manner, the locating disc 140 forms a friction fit over the webs 118 and secures insulating material thereunder. An alternative locating disc comprises a wider structure than that shown in FIG. 9(*a*) to provide improved security for the underlying insulation layer.

In use, the spacers may be located on the inner roof sheet using the temporary fixing device 124 or, more commonly, the temporary fixing device 124 will not be required unless the spacers are fitted on a vertical wall or steep roof. In either case, the insulating material is forced over the thin end of the spacer and the roof support bar is located on the spacer and secured in position using a fixing screw which has first been fitted with the sheath washer 130 as described above. The fixing screw passes through the tapped hole 114 and into the underlying roof structure to secure the spacer, and support bar to the underlying roof structure. The locating disc may be located over the spacer 110 once the insulation has been fitted and prior to fixing of the support bar. The locating disc 140 is particularly advantageous in vertical wall sections or steep roofs. As an alternative, generally, roof insulation may be fitted directly over the inner roof sheet and spacers may then be located on the insulating material in such a manner that the mounting plate 122 is located uppermost and, thereafter, the support bar may be located on the mounting plate and the sheathed washer and fixing screw applied in the conventional manner. In this way, the locating disc is not required and it will be seen that the use of the locating disc and temporary fixing screw 124 will depend upon the conditions during laying of the roof, the gradient of the roof or wall and the preference of the fitter. However, whether the spacer is fitted with the mounting plate uppermost or with the plate abutting the inner roof skin, the design of the spacer allows maximum use of insulating material with gaps in the insulating material being minimised due to the cutting edges of the webs and the space between being naturally filled with insulating material.

The locating discs provide the option of enhanced securement of the insulating material which is particularly useful in hazardous conditions and in vertical walls.

Figure 10A:
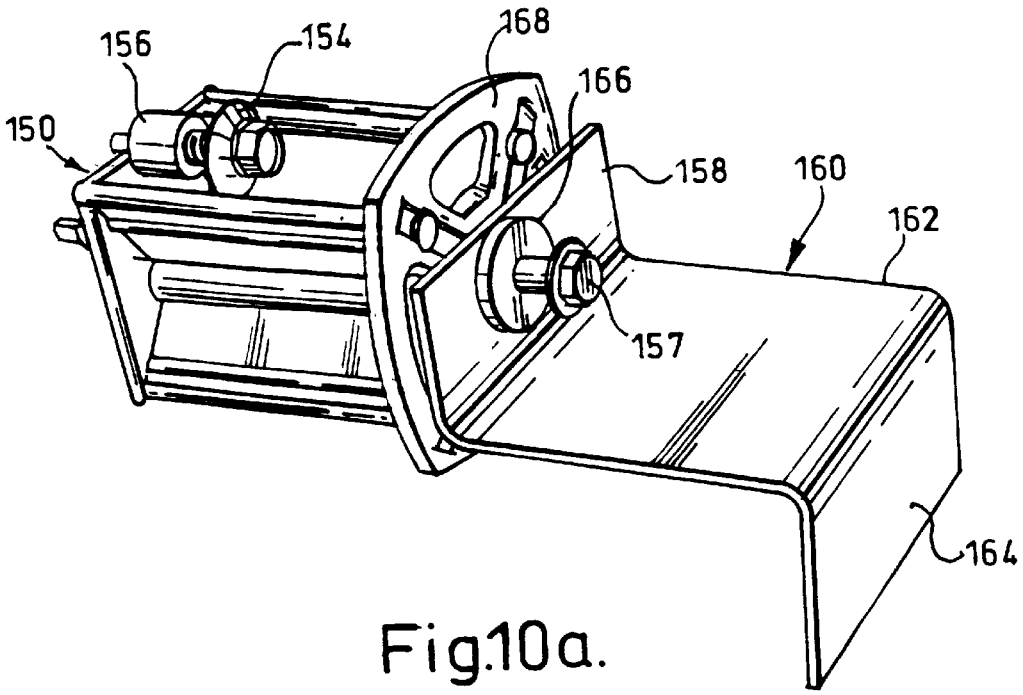
FIG. 10(*a*) shows a wall cladding arrangement for the spacer and Z bar.
Figure 10B:
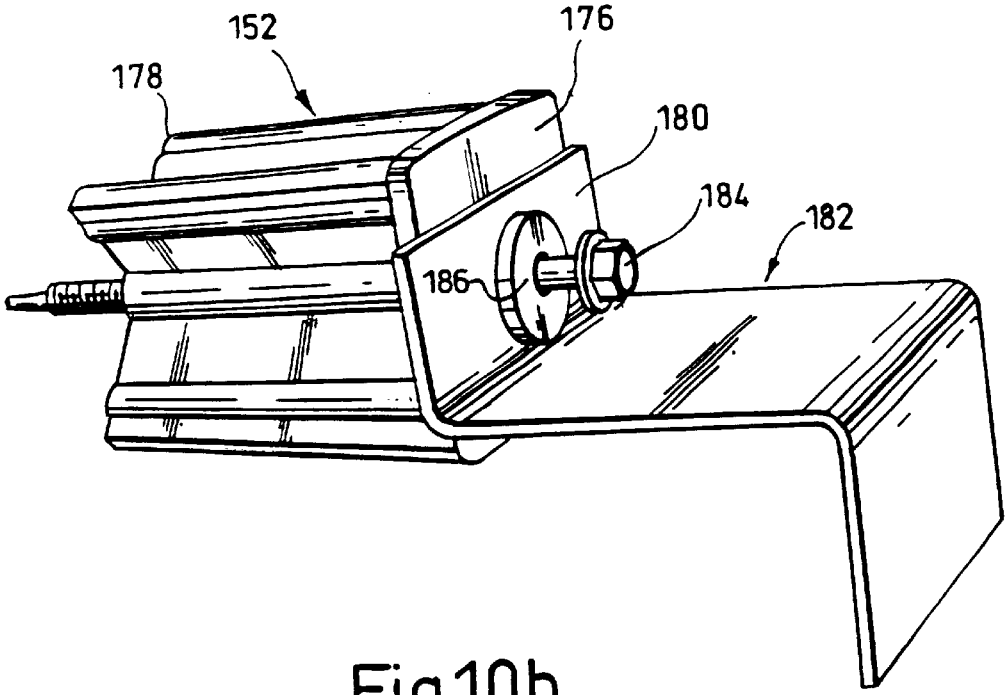
Figure 10C:
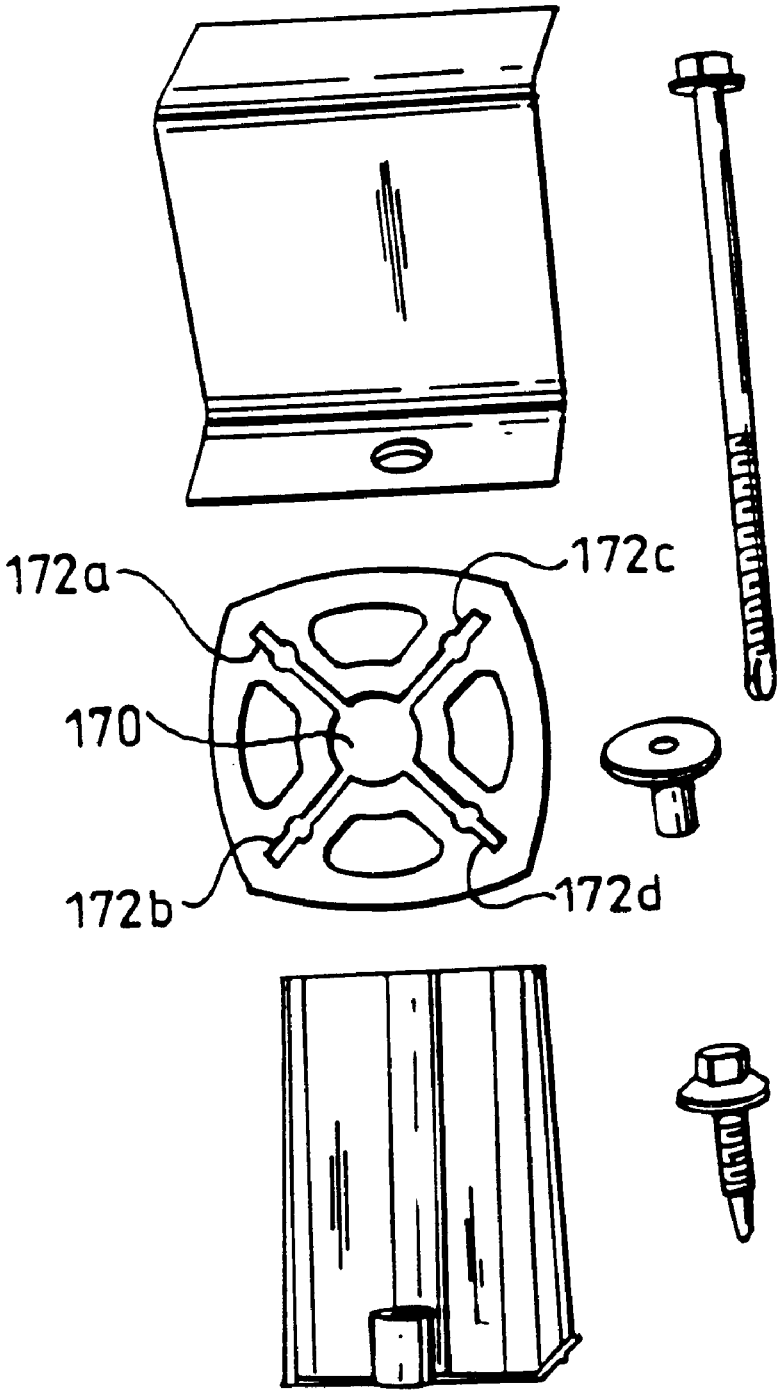

Referring to FIGS. 10(*a*) and (*b*) the alternative orientations of the spacer ferrules 150, 152 are shown. In FIG. 10(*a*), a wall cladding spacer ferrule 150 similar to the type shown and previously described with respect to FIGS. 8(*a*)–(*c*). A locating screw 154 is shown in threaded engagement with tapped fixing cylinder 156 for securement of the spacer ferrule to an underlying inner wall sheet (not shown). A permanent fixing screw 157 is shown in threaded engagement with the central tapped hole of spacer ferrule 150. The fixing screw passes through a hole in the foot plate 158 of a metal Z bar 160. The hole in the foot plate 158 is centrally disposed with respect to the sides of the rectangular foot plate. The shank of the screw 157 has located thereover an insulating washer 166 comprising a flat circular head and cylindrical sheath (not shown) which depends centrally from the said head and sheaths the upper portion of the shank of the screw from the sides of the hole formed in the foot plate 158, thus providing a thermal break between the inner and outer skins to prevent heat loss and cold bridging by preventing any metal to metal contact.

Referring to FIG. 10(*c*), a locating washer 168 is similar to the type previously described with reference to FIGS. 9(*a*) and 9(*b*) having a central hole 170, which is dimensioned to be close fitting with the outer wall of the central tapped cylinder of the spacer, and four equally spaced radially extending slots 172.

The slots 172 have formed along the length thereof a wider portion for accommodating a close fitting rib 190 formed in a corresponding position on each of the radially extending webs of the spacer ferrule. The rib extends fully along the length of the web and provides additional frictional engagement between the ferrule and locating washer as well as adding strength to the web.

As can be seen from FIG. 10(*a*), the locating washer is located over the spacer ferrule prior to mounting of the Z-bar 160. The locating washer is orientated so that the slots are located over the radial webs of the spacer ferrule before being pressed down thereover. In use, the insulating layer is placed over the ferrule prior to the locating washer so that the washer may be pressed down over the webs and onto the insulation layer to secure it in the wall cavity. The fixing screw 157 fitted with sheathing means such as washer 166 is then used to secure the foot plate 158 of the Z bar 160 to the spacer ferrule 150 and the underlying wall purlin (not shown).

Referring to FIG. 10(*b*), a roof assembly arrangement of the ferrule is shown. Spacer ferrule 152 of a similar type to that previously described with reference to FIGS. 9(*a*)–(*c*) is shown with the flat base plate 176 uppermost and the opposite ends of the webs 178 arranged for abutting engagement with the inner skin not shown. In use, the flat plate acts as a stable mounting platform for the foot plate 180 of the Z-bar 182 and also partially holds the insulation layer (not shown) in position. The manner of use of the Z-bar 182 and fixing screw 184 and sheathing washer 186 are as previously described with respect to FIG. 10(*a*). In use, the lower ends of the webs cut through the insulation layer (not shown) or accommodating cuts or tears may be made in the insulation layer to receive the web ends. This arrangement allows the insulation layer to ride up the webs to at least partially resume a less compressed state around the spacer thus further improving insulation capacity compared with prior art devices.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A building assembly comprising an inner and outer skin defining an insulating cavity, a support bar fixedly located in the cavity for mounting the outer skin thereon and insulating spacers fixedly located between the support bar and the inner skin to provide a thermal break between the inner and outer skins, the support bar being connected to the upper surface of each of the spacers by means of a metal fixing device which passes through at least a part of the support bar and secures it to the spacer and fixes the spacer to the inner skin, wherein the fixing device includes insulating means to insulate it from the support bar and prevent heat conducting contact between the fixing device and the support bar, wherein the fixing device insulating means is in the form of a washer with a socket extension thereto to thereby respectively insulate the head and sides of the said fixing device from the said support bar and wherein the dimension of the upper surface end of the spacer is smaller than the dimension of the opposite end thereof.

2. A method of assembling a twin skin roof or wall cladding on a building comprising the steps of:

(a) locating an inner skin over at least one underlying frame member;

(b) locating insulating spacers at spaced intervals on the inner skin at locations over the said underlying frame member;

(c) locating an insulation layer on the said inner skin and over the said insulating spacers;

(d) mounting an outer skin metal support bar on the insulating spacers; and (e) fixing the support bar to each insulating spacer and each spacer to the inner skin and underlying frame member with a metal fixing device; wherein the said metal fixing device includes insulating means to insulate it from the support bar and prevent heat conducting contact between the fixing device and the support bar, wherein the fixing device insulting means is in the form of a washer with a socket extension thereto to thereby respectively insulate the head and sides of the said fixing device from the said support bar and wherein the dimension of the upper surface end of the spacer is smaller than the dimension of the other end thereof.

3. A building assembly according to claim 1, wherein the outer skin is secured to the support bar.

4. A building assembly according to claim 1, wherein the support bar is a metal Z-bar.

5. A building assembly according to claim 1, wherein an insulation layer is held in place over the spacers by means of a locating washer which is close fitting with the spacer and may be placed therearound to hold the insulation layer in position.

6. A building assembly according to claim 5, wherein the locating washer has sufficient cross-sectional area to prevent the insulation layer being lifted thereabove without tearing of the layer.

7. A method according to claim 2, wherein insulating material is fitted over the spacer, prior to securement of the support bar and outer skin, thereby engaging the smaller end first.

8. A building assembly according to claim 1, wherein at least one of the spacers comprises support webs, one end of which provides a cutting edge for the insulating material.

9. A building assembly according to claim 8, wherein the cutting edge forms the narrower end of the spacer so that insulating material may be cut into, using the narrower end of the web, and then advanced thereover towards the wider ends of the said webs.

10. A building assembly according to claim 9, wherein the outer sides of such webs also provide cutting edges for the said insulating material.

11. A building assembly according to claim 1, wherein at least one of the spacers comprises a plurality of radially extending webs.

12. A building assembly according to claim 11, wherein the webs are mounted on a flat plate at the wider end thereof.

13. A building assembly according to claim 1, wherein locating discs are provided which are locatable over the spacers after laying an insulation material thereover so that the insulation material is secured in position.

14. A building assembly according to claim 13, wherein, the locating disc is designed with a receiving section and web accommodating cut-outs.

15. A building assembly according to claim 14, wherein the radial outer limit of the web cut-outs is designed to be close fitting with the outer radial edge of the spacer webs at a predetermined distance from the top of the spacer, suitable for securing the insulating material.

16. A method according to claim 4, wherein the spacer comprises support webs, one end of which provides a cutting edge for the insulating material.

17. A method according to claim 16, wherein the cutting edge forms the narrower end of the spacer so that insulating material may be cut into, using the narrower end of the web, and then advanced thereover towards the wider ends of the said webs.

18. A method according to claim 17, wherein the outer sides of such webs also provide cutting edges for the said insulating material.

19. A method according to claim 4, wherein the spacer comprises a plurality of radially extending webs.

20. A method according to claim 19, wherein the webs are mounted on a flat plate at the wider end thereof.

* * * * *